US007757857B2

(12) United States Patent
Liang

(10) Patent No.: US 7,757,857 B2
(45) Date of Patent: Jul. 20, 2010

(54) PLASTIC BAG FOR VACUUM PACKING

(76) Inventor: Guoqiang Liang, Room 701 No. 18 No. 741 Dongfengdong road, Guangzhou, Guangdong (CN) 510080

( * ) Notice: Subject to any disclaimer, the term of this patent is extended or adjusted under 35 U.S.C. 154(b) by 113 days.

(21) Appl. No.: 12/111,957

(22) Filed: Apr. 29, 2008

(65) Prior Publication Data

US 2008/0264821 A1 Oct. 30, 2008

(30) Foreign Application Priority Data

Apr. 30, 2007 (CN) ..... 2007 2 0051152 U

(51) Int. Cl.
*B65D 81/20* (2006.01)
*B65D 33/01* (2006.01)

(52) U.S. Cl. ..... 206/524.8; 206/484; 383/100; 383/103

(58) Field of Classification Search ..... 206/484, 206/524.8; 383/100–103, 105, 109; 428/35.2, 428/35.4
See application file for complete search history.

(56) References Cited

U.S. PATENT DOCUMENTS

RE34,929 E * 5/1995 Kristen ..... 206/524.8
5,549,944 A * 8/1996 Abate ..... 428/35.2
6,799,680 B2 * 10/2004 Mak ..... 206/524.8
6,991,109 B1 * 1/2006 Shannon et al. ..... 206/524.8
7,270,238 B2 * 9/2007 Shannon ..... 206/524.8
7,578,320 B2 * 8/2009 Borchardt ..... 383/103
2004/0007494 A1 * 1/2004 Popeil et al. ..... 206/524.8
2004/0050745 A1 * 3/2004 Lee et al. ..... 206/524.8
2005/0238263 A1 * 10/2005 Ping ..... 383/100
2005/0286808 A1 * 12/2005 Zimmerman et al. ..... 383/105

* cited by examiner

*Primary Examiner*—Bryon P Gehman

(57) ABSTRACT

The plastic bag for vacuum packing provided by the present invention has embossments which space in longitudinal direction and stagger in transverse direction formed on the inner surface, and thus lots of intercommunicate channels are formed so as to eliminate the possibility to form any air pocket or internal cavity. Meanwhile, air linearly exits from the bottom to the open end, so it takes less time to evacuate the bag. Further, the bag only has one film be embossed, and thus the manufacturing process thereof is simplified and at low cost, and the bag is easy to wash. Moreover, the strength of the bag provided by the present invention is enhanced; especially the anti-avulsion capability is well improved.

7 Claims, 7 Drawing Sheets

PLASTIC BAG FOR VACUUM PACKING

FIELD OF THE INVENTION

The present invention relates to packaging materials and, in particular, to a plastic bag for vacuum packing.

BACKGROUND OF THE INVENTION

Vacuum packing is a common method for storage, in which, a bag is evacuated to prevent decomposition or oxidation of the item therein by the ubiquitous bacteria in the air. Generally, when a user desires to vacuum pack food or the like using a vacuum bag, the food is put into a vacuum bag. Afterwards, air is drawn from the vacuum bag and an open end of the vacuum bag is sealed by a vacuum packing apparatus. However, some bags used in vacuum packaging are composed of two pieces of flat plastic films. The flat surfaces of the films are easy to be jointed together when the bag is evacuated, and thus makes air pockets be trapped in the bag, rendering the bag unsuitable for vacuum packaging of perishable items. In order to achieve a desirable vacuum, lots of efforts were made in the prior art.

One improved type of bags with embossments has been widely used in our daily life. A plurality of embossments each extends from the bottom to the open end of the bag is formed on the inner surface of the bag. When an item is vacuum packed, an air discharge path is defined by the embossments. However, when an item is put into the bag, an internal cavity may be formed between the bottom of the bag and the item. The air in the cavity will not be evacuated because the item obstructs the air discharge path. Thus a desirable vacuum cannot be obtained.

Another conventional type of vacuum bag is disclosed in Chinese patent publication No. 2736281, which has strip ridges (or grooves) on both plastic films thereof. The ridges (or the grooves) formed on the films are perpendicular with each other, and thus air flows along the channel defining by the ridges (or the grooves). However, forming the ridges (or the grooves) on both films makes the manufacturing process complex and costly.

Chinese Patent Publication No. 2312897 and U.S. Pat. No. RE 34929 disclose two conventional types of plastic bags for vacuum packing, which have ridges densely covered on one plastic film. When the bag is evacuated, air is extracted along the channels defined by two adjacent ridges. The channels are intercommunicated, so that there is no said internal cavity in the bag. However, in order to adapt for the use of sealer, the ridges formed on the bag are diagonal or curvilinear in the direction from the bottom to the open end of the bag, which results in that the air will not linearly extracted from the bag. So, it takes more time to evacuate the bag. Furthermore, the above described bags are of less strength, and they are easy to be destroyed when there is a breach on the film.

U.S. Pat. No. 6,991,109 titled "Vacuum Sealable Bag Apparatus and Method", issued to Daniel P. Shannon on Jan. 31, 2006, also describes a storage bag with a venting strip formed therein to assist in evacuating the bag. The venting strip can be apertured and/or can have a textured or rough surface that creates channels between the inside surface of the storage bag and the venting strip, thereby allowing air to exit from the interior of the bag. However, the venting strip makes the manufacturing process complicated and is difficult to clean. Moreover, the strip may easily be cracked which makes the bag unsuitable for repeated use.

SUMMARY OF THE INVENTION

It is an object of the present invention to provide an improved plastic bag for vacuum packing such that air can be completely extracted from the bag.

It is another object of the present invention to provide a plastic bag for vacuum packing such that it takes less time to evacuate the bag.

It is still another object of the present invention to provide a plastic bag for vacuum packing with higher strength and durability, and lower cost.

It is a further object of the present invention to provide a plastic bag for vacuum packing such that the manufacturing process thereof is simplified.

To achieve the objects set forth above, the present invention provides a plastic bag for vacuum packing comprising a first film with a flat surface and a second film with embossments, each of the films comprising a uniform inner surface which films are joined together at least at opposite lateral sides of the films to define a chamber adapted to have an item disposed therein, and the embossments are formed on the inner surface of the second film. The embossments are arranged at intervals separated from each other and aligned in a direction parallel with said lateral sides, the aligned embossments thereby defining a line of embossments. The embossments defining a plurality of said line of embossments, two adjacent lines of said embossments constitute a gas-exiting unit, where said two lines of embossments are arranged parallel with each other and staggered, so that each embossment in one said line of embossments is adjacent to a gap between the two adjacent embossments in the other said line of embossments. A plurality of the gas-exiting unit is arranged on the inner surface of the second film so that the whole inner surface is covered; and each of said embossments consists of a group of more than one protuberance, and these protuberances are arranged at intervals and are parallel to each other. Preferably, each said protuberances has the same length. In a preferable example of the present invention, at least two protuberances of each of said embossments which said at least two protuberances locate outmost are shorter than the other protuberances of the same embossment, and said other protuberances are of the same length.

In another preferable embodiment of the present invention, the shape of the end of the protuberance in each of the embossments is of a semicircle, a rectangle and a triangle. Preferably, the end is a semicircle.

The plastic bag for vacuum packing provided by the present invention only has one side of films to be embossed, and thus the manufacturing process thereof is simplified and at low cost. Further, the bag is easily to clean because of the absence of the venting strip. The embossments are spaced in longitudinal direction and staggered in transverse direction, and thus lots of intercommunicate channels are formed. Air exits from the bottom to the open end linearly or nearly linearly, so it takes less time to evacuate the bag. Moreover, the channels are intercrossed so as to eliminate the possibility to form any air pocket or internal cavity. Additionally, the embossments formed on the plastic bag provided by the present invention are arranged at intervals and staggered, so the strength of the bag is enhanced.

These and other objects, advantages and features of the present invention will become apparent by reference to the detailed description provided below which is to be considered in conjunction with the accompanying drawings.

BRIEF DESCRIPTION OF THE ACCOMPANYING DRAWINGS

Figure 4:
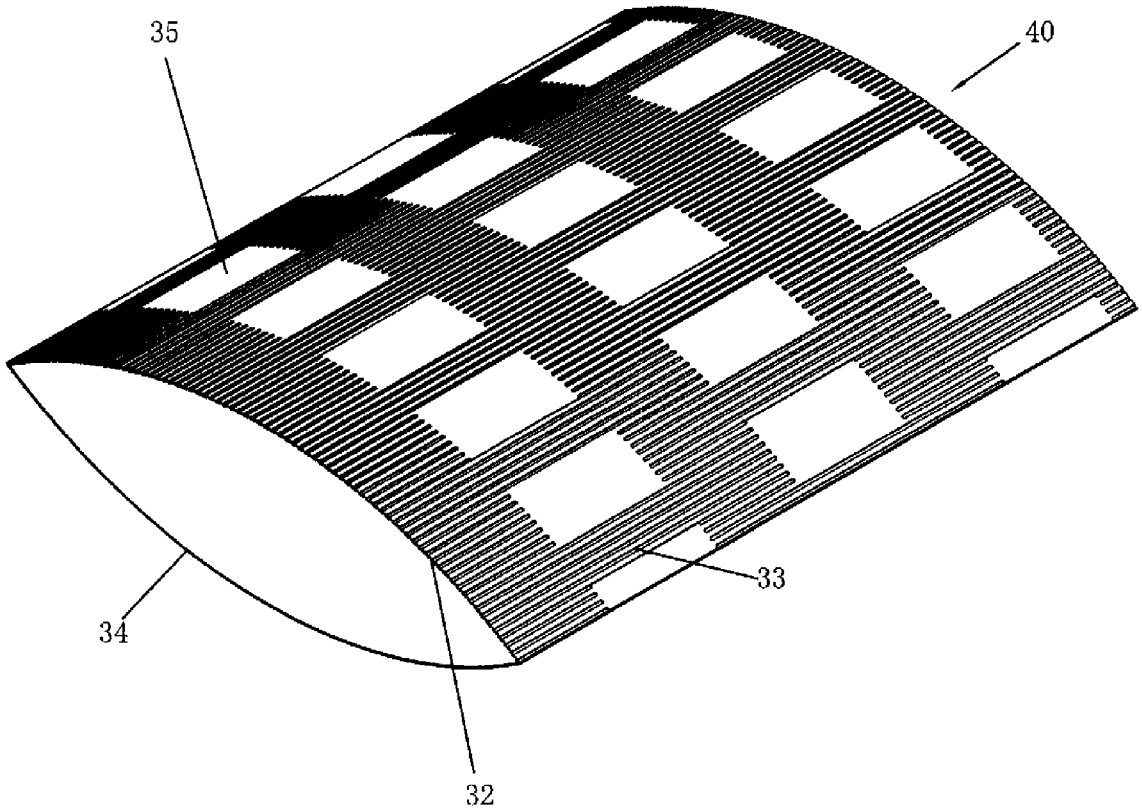
FIG. 4 illustrates another plastic bag according to another preferable embodiment of the present invention.
Figure 7:
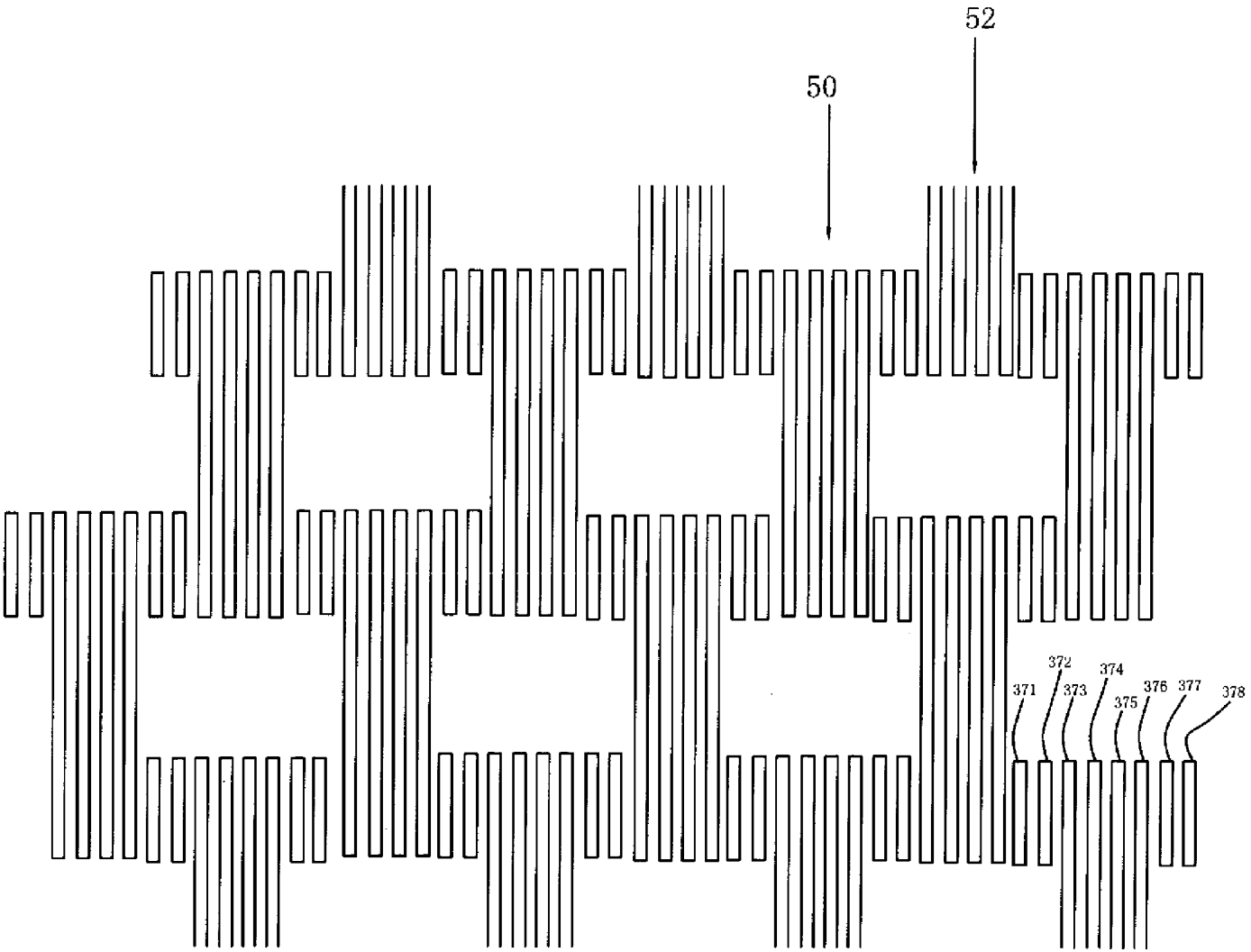

FIG. 7 schematically illustrates the arrangement of the embossments formed on the film of the bag shown in FIG. 4.

DETAILED DESCRIPTION OF A PREFERABLE EMBODIMENTS

Figure 1:
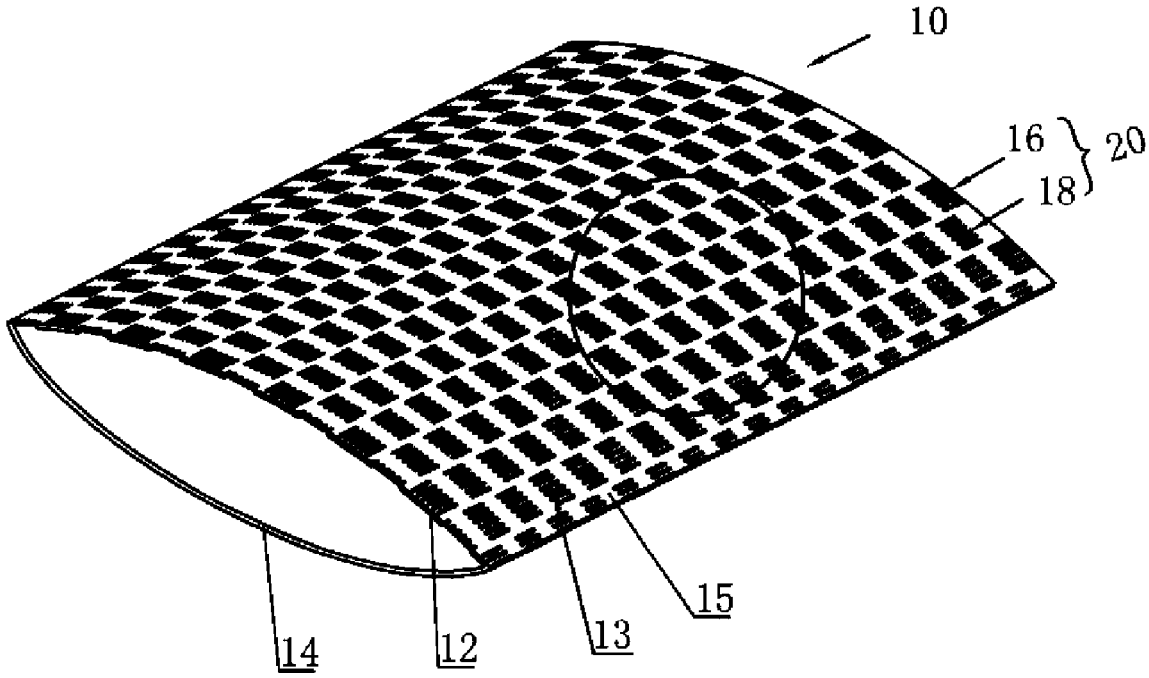
FIG. 1 illustrates a plastic bag according to one preferable embodiment of the present invention.

FIG. 1 shows a plastic bag 10 according to a first embodiment of the present invention. The bag 10 comprises a first film 14 and a second film 12, joined together at the opposite lateral sides and a bottom side to define a chamber adapted to have an item disposed therein. The inner and outer surfaces of the first film 14 are both flat, but on the inner surface of the second film 12 are formed embossments. The embossments are arranged at intervals separated from each other and aligned in a direction parallel with said lateral sides, the aligned embossments thereby defining a line of embossments. A gap between two adjacent embossments in a line of embossments is labeled as numeral 15. The embossments defining a plurality of said line of embossments, and two lines of said embossments (for example, a first line of embossment 16 and a second line of embossments 18) constitue a gas-exiting unit (such as unit 20), where the first line of embossments 16 and the second line of embossments 18 are arranged parallel with each other and staggered, so that each embossment 13 in the second line 18 is adjacent to the gap 15 between the two adjacent embossments in the first line 16. A plurality of the gas-exiting units 20 is arranged on the inner surface of the second film 12 so that the whole inner surface is covered.

Figure 2:
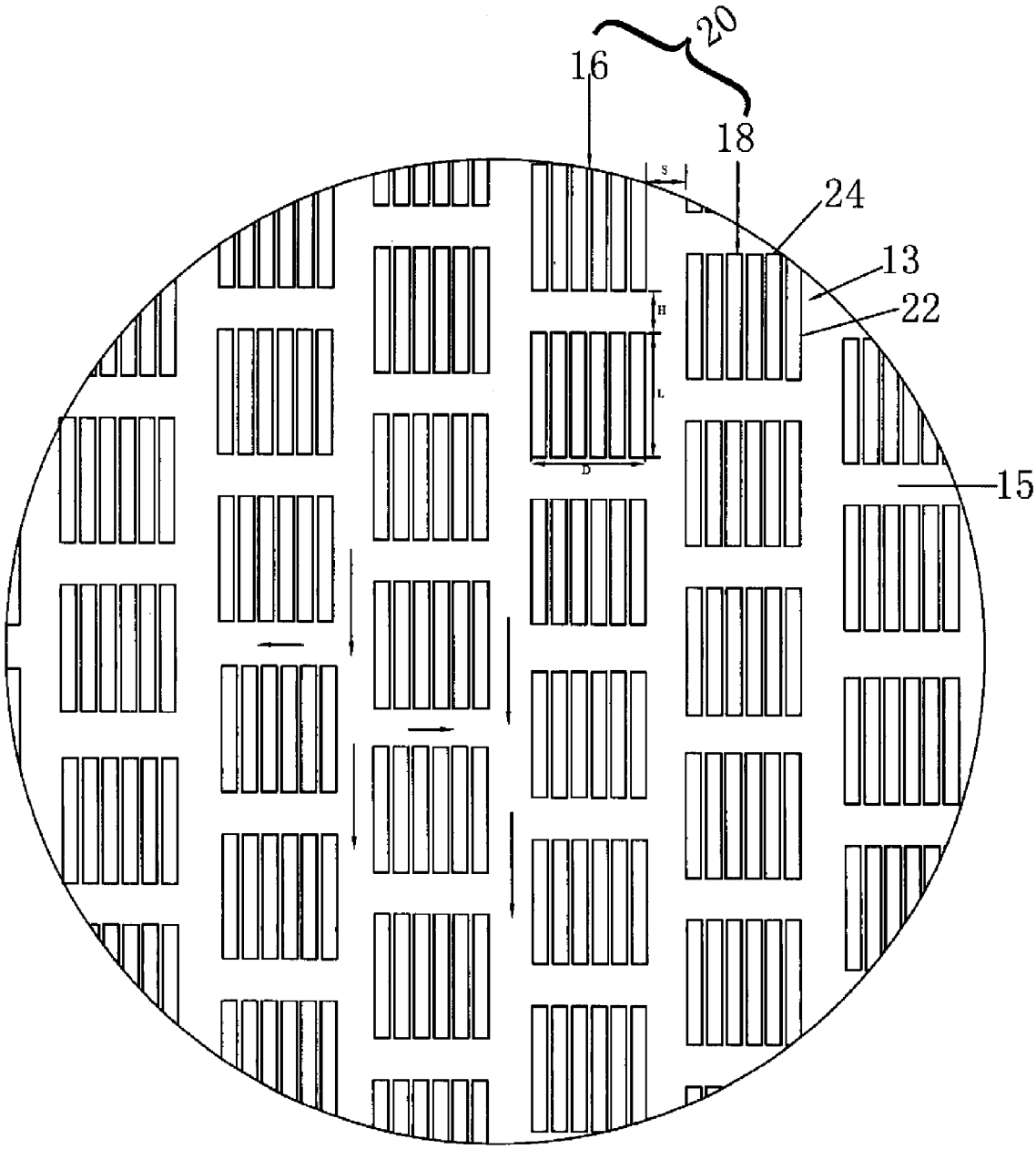
FIG. 2 is an enlarged view illustrating the circle portion shown in FIG. 1.
Figure 2A:
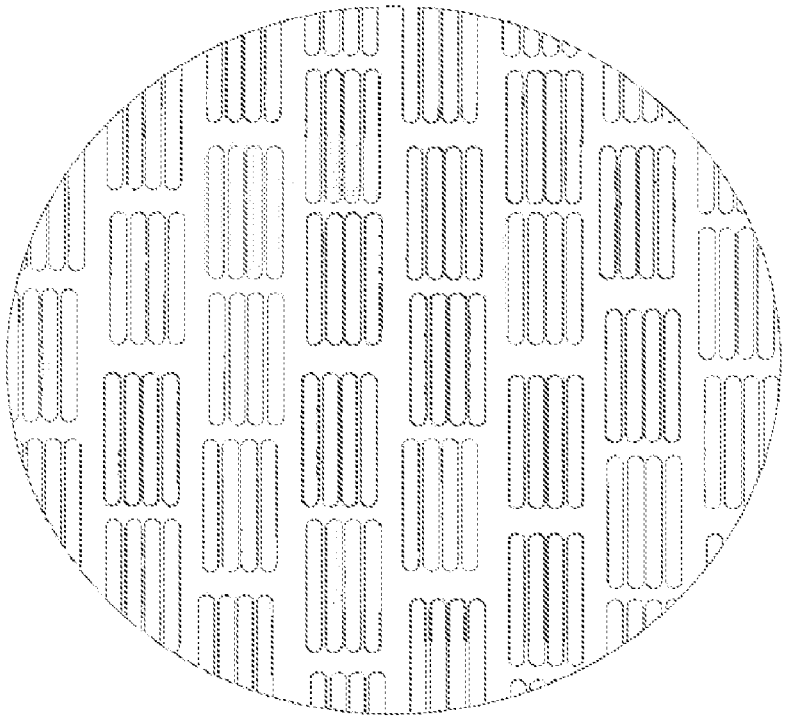
FIG. 2*a* is another example of the plastic bag of FIG. 1 showing each embossment having four protuberances and the shape of the end of the protuberance being a semicircle.
Figure 2B:
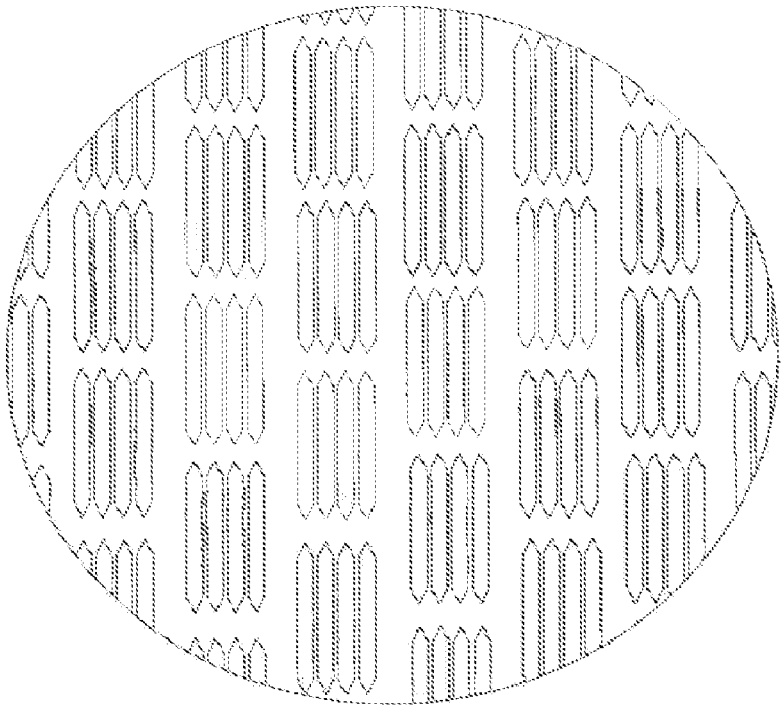
FIG. 2*b* is still another example of the plastic bag of FIG. 1 showing the shape of the end of the protuberance being a triangle.

FIG. 2 shows an enlarged view of the circle portion shown in FIG. 1. In this embodiment, the embossment 13 is composed of six protuberances arranged at intervals and parallel to each other, and each of these protuberances has the same length. The length of the embossment 13 in a direction parallel with said lateral sides is labeled as "L" (that is the length of the protuberance 22); the length of the embossment 13 perpendicular to the direction parallel with the lateral sides is labeled as "D"; the space between the first line 16 and the second line 18 is labeled as "S"; and the gap between two adjacent embossments in the same line is labeled as "H". H and S have appropriate size, such that the second film 12 dose not close joint with the first film 14 until the air between the gap 15, or the space between the first line of embossments 16 and the second line of embossments 18, and the bottom of the bag is evacuated. Also, L and D depend on the length and width of the bag. For example, L is at least shorter than the length of the bag in a direction parallel with the lateral sides, and D is at least shorter than the length of the bag perpendicular to the direction parallel with the lateral sides. The person skilled in the art will easily determine the appropriate magnitudes of L, H, D and S based on limited simple experiments.

When the bag is evacuated, the air in the bag will exhaust through the channel (or referred as "groove") formed by the embossment and the inner surface of the first film 14. Specifically, on the one hand, air will exit along the interspace between two adjacent protuberances (for example, the protuberance 22 and another protuberance 24), so the exiting path of the air is linear which accelerate the evacuation. On the other hand, when S is small enough, the air can also exit along the space between two lines of embossments (for example, the first line of embossments 16 and the second line of embossments 18). Additionally, the clearances between adjacent embossments (such as clearance 15) are employed to achieve the interconnection of different grooves. When H is small enough, the clearance 15 will not close joint with the flat film while evacuating, so that any residual air can be effectively guided through the clearance 15. Further, the gap between the two adjacent embossments in a line of embossments will not be arranged in a line paralleling the open end of the bag because of the stagger arrangement of the embossments. Thus, if the present invention is used in a conventional vacuum sealer, the circumstance that the air cannot be exhausted from the bag due to the press of the sealer can be avoided. Therefore, a conventional sealer can apply to the present invention.

Figure 3:
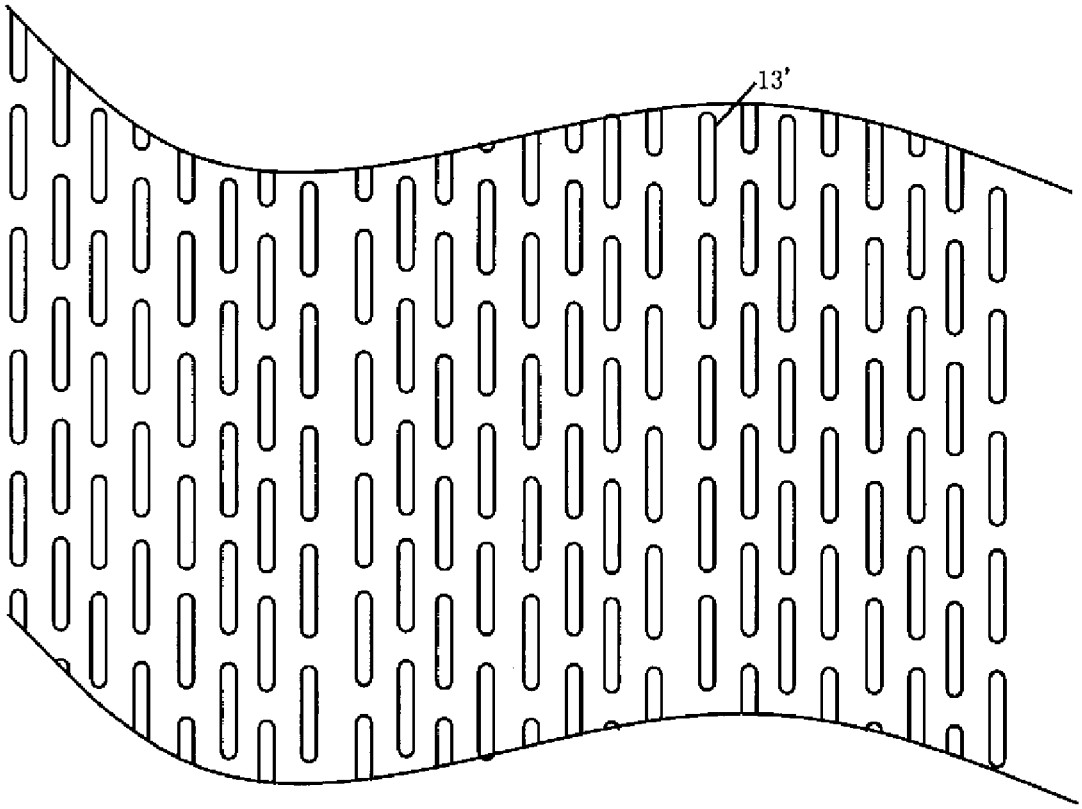
FIG. 3 is an enlarged view illustrating the embossments arranging manner in another example of the present invention.

FIG. 3 schematically shows the arrangement of the embossments formed on the inner surface of the second film 12 according to another preferable embodiment of the present invention. In this embodiment, the embossment 13' only consists of one protuberance. The arrangement manner is the same as described above, simply the shape of the end of the protuberance in a direction parallel with the lateral sides being semicircular which is different from the rectangular shape of the protuberance shown in FIG. 2. The semicircular end can reduce the friction with air and therefore speed up the air flow. Obviously, the end can be formed in triangle or any other shapes so long as to assist the air flow, or the whole protuberance can be formed as a cylinder with slippery surface.

Figure 5:
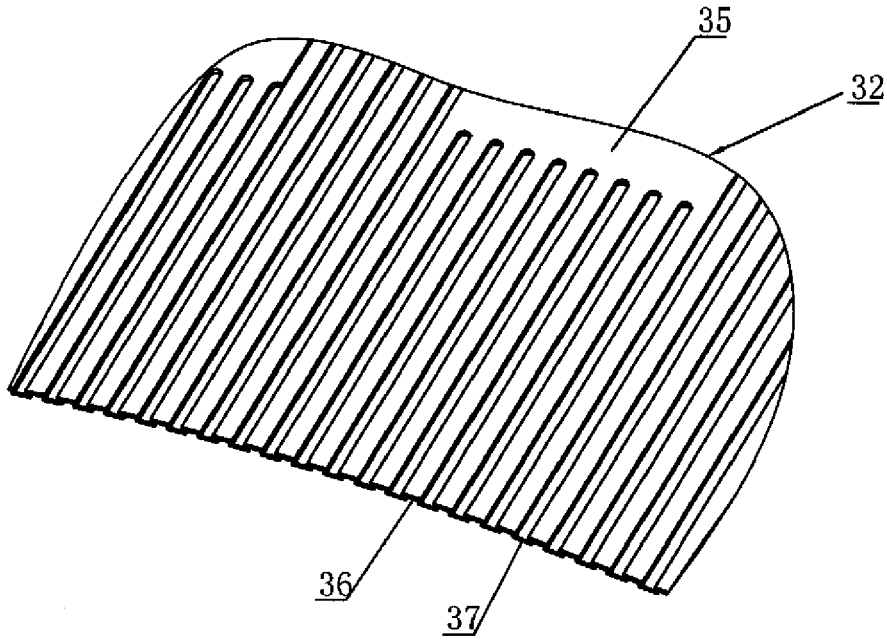
FIG. 5 is an enlarged view illustrating the embossments arranging manner of the bag shown in FIG. 4.
Figure 6:
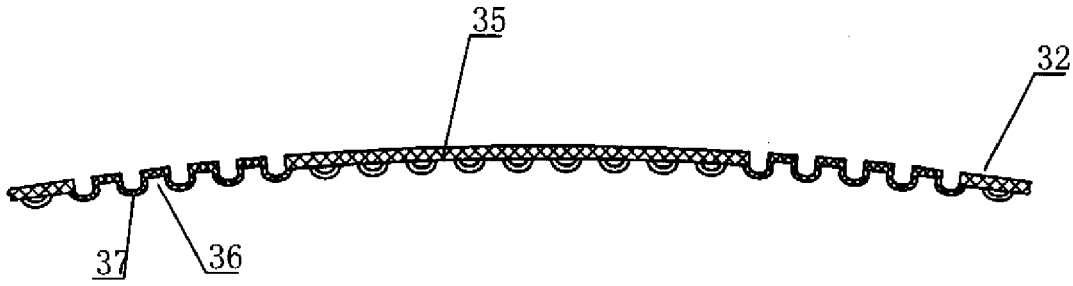
FIG. 6 is a cross-sectional view illustrating the structure of the plastic bag shown in FIG. 4.

Referring now to FIG. 4 which shows another plastic bag according to another preferable embodiment of the present invention. The bag 40 comprises a first film 34 and a second film 32, joined together at the opposite lateral sides and a bottom side to define a chamber adapted to have an item disposed therein. The inner and outer surfaces of the first film 34 are both flat, but on the inner surface of the second film 32 are formed a plurality of embossments 33. As shown in FIGS. 5-7, the embossment 33 consists of eight protuberances 37, arranged at intervals separated from, and are parallel to, each other. The four outmost protuberances (such as protuberance 371, 372, 377 and 378) are shorter than the other four protuberances (such as protuberance 373, 374, 375 and 376), and said other four protuberances have the same length. Ajacent protuberances form a groove 36 provided for air flow.

In this example, referring to FIG. 7, the embossments are arranged at intervals separated from each other and aligned in a direction parallel to said lateral sides, the aligned embossments thereby defining a line of embossments. A gap between two adjacent embossments in a line of embossments is labeled as numeral 35. Two lines of said embossments (for example, a first line 50 and a second line 52) constitute a gas-exiting unit, where a first line of embossments 50 and a second line of embossments 52 are arranged parallel with each other and staggered, such that each embossment 33 of the second line of embossments 52 is adjacent to the gap 35 between two adjacent embossments of the first line of embossments 50. A plurality of the gas-exiting unit is arranged on the inner surface of the second film 32 so that the whole inner surface is covered.

When the bag is evacuated, the air in the bag will exhaust through the channel (or referred as "groove") formed by the embossments and the inner surface of the first film 34. Specifically, air exits along the space between said two lines of embossments (for example, the first line of embossments 50 and the second line of embossments 52), so the exiting path of the air is linear which accelerate the evacuation. Also, the clearances between adjacent embossments (such as gap 35) are employed to achieve the interconnection of different grooves. When the area of the gap 35 is small enough, it will not close joint with the flat film while evacuating, so that any residual air can be effectively guided through the gap 35. Further, the space between the two adjacent embossments in a line of embossments will not be arranged in a line paralleling the open end of the bag because of the stagger arrangement of the embossments. Thus, if the present invention is used in a conventional vacuum sealer, the circumstance that the air cannot be exhausted from the bag due to the press of the sealer can be avoided. Therefore, a conventional sealer can apply to the present invention.

As known to the person skilled in the art, the embossments or the protuberances on the inner surface of the second film can be formed by compression molding or laminating method. The film can be made of polypropylene, polyethylene, high-density polyethylene, nylon or mixtures thereof.

The plastic bag for vacuum packing provided by the present invention has embossments which space in longitudinal direction and stagger in transverse direction formed on the inner surface, and thus lots of intercommunicate channels are formed so as to eliminate the possibility to form any air pocket or internal cavity. Meanwhile, air linearly exits from the bottom to the open end, so it takes less time to evacuate the bag. Further, the bag only has one film be embossed, and thus the manufacturing process thereof is simplified and at low cost, and the bag is easy to wash. Moreover, the strength of the bag provided by the present invention is enhanced, especially the anti-avulsion capability is well improved.

The bag can be made as individual bags or as continuous bag rolls. In many cases, the roll consists of a continuous tube of sheet material which is cut to a desired length and can be heat seal on an open end of the tube to form a bag.

It should be understood that various alternatives to the embodiments of the present invention described herein may be employed in practicing the invention. It is intended that the following claims define the invention and that structures within the scope of these claims and their equivalents be convered thereby.

What is claimed is:

1. A plastic bag for vacuum packing comprising a first film with a flat surface and a second film with embossments, each of said films comprising a uniform inner surface which films are joined together at least at opposite lateral sides of the films to define a chamber adapted to have an item disposed therein, and said embossments are formed on the inner surface of said second film, wherein each of said embossments consists of a group of more than one protuberance and these protuberances are arranged at intervals and are parallel to each other;

the embossments are arranged at intervals separated from each other and aligned in a direction parallel with said lateral sides, the aligned embossments thereby defining a line of embossments;

the embossments defining a plurality of said line of embossments, two adjacent said lines of embossments constitute a gas-exiting unit, and the said two lines of embossments are arranged parallel with each other and staggered, such that each embossment in one said line of embossments is adjacent to a gap between two adjacent embossments in the other said line of embossments;

a plurality of said gas-exiting unit is arranged on the inner surface of said second film so that the whole inner surface is covered.

2. The plastic bag for vacuum packing of claim 1 wherein each of said embossments consists of four protuberances.

3. The plastic bag for vacuum packing of claim 1 wherein each said protuberance has the same length.

4. The plastic bag for vacuum packing of claim 1 wherein at least two protuberances of each of said embossments which said at least two protuberances located outmost of the embossment are shorter than the other protuberances of the same embossment, and said other protuberances are of the same length.

5. The plastic bag for vacuum packing of claim 1 wherein each gap between two adjacent embossments in either adjacent line of embossments has the same length.

6. The plastic bag for vacuum packing of claim 1 wherein the shape of the end of the protuberance in each of the embossments is one of a semicircle, a rectangle and a triangle.

7. The plastic bag for vacuum packing of claim 6 wherein the shape of the end of the protuberance in each of the embossments is a semicircle.

* * * * *